US005487347A

United States Patent [19]

Kogawara

[11] Patent Number: 5,487,347

[45] Date of Patent: Jan. 30, 1996

[54] LOOPER THREAD PAYING-OUT APPARATUS FOR SEWING MACHINE

[75] Inventor: Satoshi Kogawara, Tokyo, Japan

[73] Assignee: Juki Corporation, Tokyo, Japan

[21] Appl. No.: 340,636

[22] Filed: Nov. 16, 1994

[30] Foreign Application Priority Data

Nov. 17, 1993 [JP] Japan ..... 5-288109

[51] Int. Cl.[6] ..... D05B 49/00; D05B 47/00

[52] U.S. Cl. ..... 112/242; 112/254; 112/302

[58] Field of Search ..... 112/181, 199, 112/241, 248, 242, 302, 254, 255, 197, 200

[56] References Cited

U.S. PATENT DOCUMENTS

| | | | |
|---|---|---|---|
| 2,725,840 | 12/1955 | Zeier | 112/254 |
| 4,325,314 | 4/1982 | Niem | 112/199 |
| 4,917,033 | 4/1990 | Satoma | 112/254 X |
| 4,991,528 | 2/1991 | Bellio | 112/197 X |
| 5,249,538 | 10/1993 | Nakano et al. | 112/255 X |

FOREIGN PATENT DOCUMENTS

| | | | |
|---|---|---|---|
| 3136691 | 6/1991 | Japan | 112/197 |

*Primary Examiner*—C. D. Crowder
*Assistant Examiner*—Ismael Izaguirre
*Attorney, Agent, or Firm*—Tarolli, Sundheim & Covell

[57] ABSTRACT

The present invention provides a looper thread paying-out apparatus of sewing machine in which apparatus a variation of paying-out tension of the thread from a bobbin does not affect a seam.

Just before a thread tensioner of a looper system which feeds a looper thread from a bobbin of sewing machine through to thread tensioner, an auxiliary paying-out apparatus is provided for paying out previously a portion of thread for a length of one stitch corresponding to an amount of horizontal cloth feed and feeding that portion into the thread tensioner at zero tension.

6 Claims, 6 Drawing Sheets

LOOPER THREAD PAYING-OUT APPARATUS FOR SEWING MACHINE

BACKGROUND OF THE INVENTION

The present invention relates to a looper thread paying-out apparatus in a sewing machine for feeding a thread from a bobbin through a thread tensioner to seam forming means.

In the prior sewing machine a paying-out of thread from a bobbin has been carried out by a thread take-up arranged between a thread tensioner and the seam forming means such as a needle or looper. At the same time with this paying-out of thread by the thread take-up a stitch is further fastened.

Therefore, in the case of a bobbin in which a thread paying-out tension was easily variable there was a problem that an amount of thread paid out by the thread take-up was not constant resulting in a non-uniform seam because the amount of thread paid out by the thread take-up must be set up in consideration of the thread paying-out tension.

For example, in the case of multi-thread chain stitch in an interlock sewing machine, it has a problem that a stitch is varied depending on a thread paying-out tension in such a way that upon a lower thread paying-out tension the stitch as shown in FIG. 7(A) is obtained and upon a higher thread paying-out tension a stitch as shown in FIG. 7(B) is obtained.

In particular, such a variation of stitch is found noticeably at an intermittent sewing or at a transfer of sewing speed from a lower speed to a higher speed so that it was very difficult to control an amount of thread paid out by a thread take-up and an amount of thread paying-out by a spring pressure of thread tensioner.

SUMMARY OF THE INVENTION

Therefore, from the consideration of the above-mentioned prior problems, it is an object of the present invention to provide a looper thread paying-out apparatus of sewing machine capable of producing a constant stitch regardless of a variation of tension for paying out a thread from a bobbin.

This object is attained according to the present invention by a looper thread paying-out apparatus of sewing machine for feeding a thread from a bobbin through a thread tensioner to seam forming means characterized in that between the bobbin and the thread tensioner an auxiliary paying-out apparatus is arranged for paying out a portion of thread for a length of one stitch just before each stitching is effected corresponding to each stitching movement of the looper.

Also, the auxiliary paying-out apparatus can be comprised of an auxiliary thread take-up pivotably mounted to a feed rock shaft for driving a horizontal cloth feed mechanism and a thread guide for drawing out and accumulating a portion of thread for a length of one stitch just before the thread is drawn out through a thread tensioner and a thread take-up into a looper by cooperating with the free end of said auxiliary thread take-up wherein said auxiliary paying-out apparatus is located near said free end of said auxiliary take-up.

In addition, the auxiliary paying-out apparatus can be provided with a pulse motor for paying out a thread by being rotated corresponding to an amount of cloth feed at a horizontal cloth feed mechanism.

According to the invention, a stable seam can be obtained always by being capable of making thread tension constant to zero, regardless of a tension for paying out a thread from a bobbin, at the moment of thread paying-out by a thread take-up located after the thread tensioner because a thread is paid out into the front of the thread tensioner from the auxiliary paying-out apparatus at each stitch of sewing needle.

Also, according to the invention, it is possible to adjust automatically an amount of thread paying-out before the thread tensioner corresponding to an amount of cloth feed because the auxiliary thread take-up of the auxiliary paying-out apparatus is pivotably mounted to a feed rock shaft for driving a horizontal cloth feed mechanism.

Further, according to the invention, it is possible to make the seam stable by feeding a required amount of thread into the front of a thread tensioner because the auxiliary paying-out apparatus pays out a thread by a pulse motor corresponding to an amount of horizontal cloth feed.

BRIEF DESCRIPTION OF THE DRAWINGS

The foregoing and other features the present invention will become apparent to one skilled in the art to which the present invention relates upon consideration of the following description of the invention with reference to the accompanying drawings, in which.

DESCRIPTION OF A PREFERRED EMBODIMENT

Figure 2:
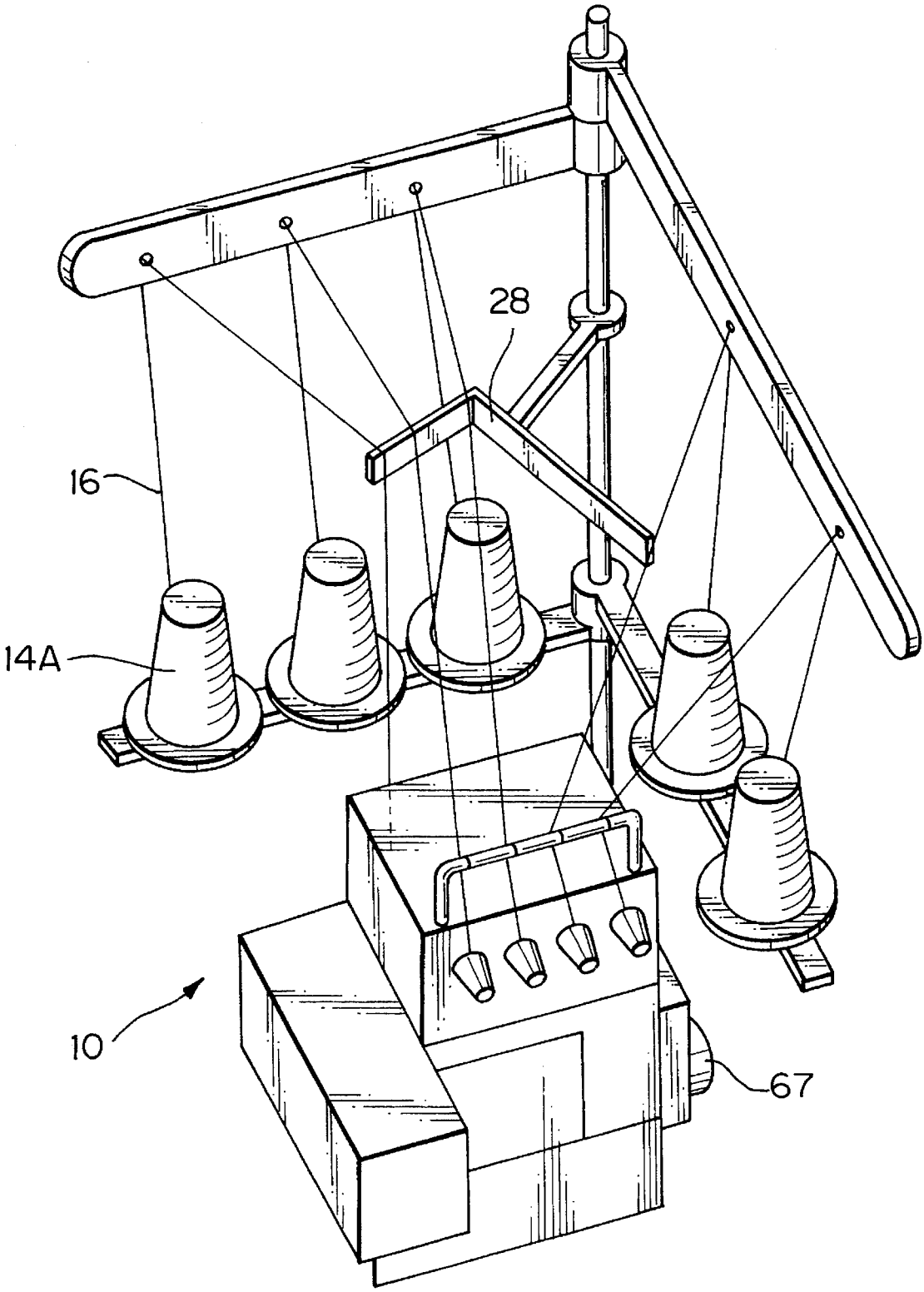
FIG. 2 is a schematic perspective view showing an interlock sewing machine to which the looper thread paying-out apparatus according to the present invention will be applied.
Figure 3:
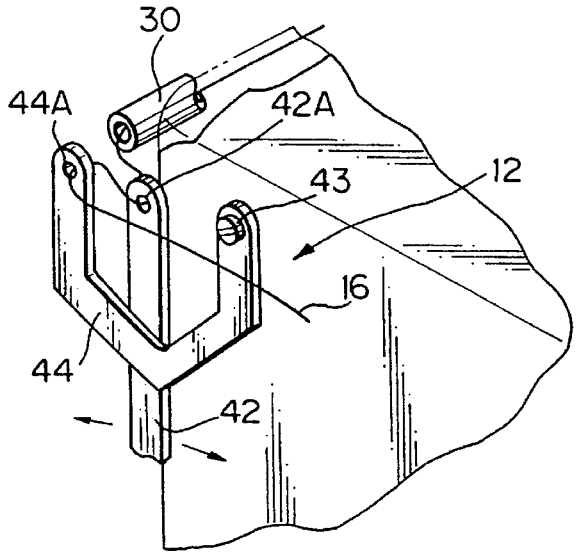
FIG. 3 is an enlarged perspective view showing the auxiliary paying-out apparatus of the same embodiment as shown in FIG. 1.

In this embodiment, a looper thread paying-out apparatus of an interlock sewing machine 10 as shown in FIG. 2 is provided with an auxiliary paying-out apparatus 12 of the present invention.

The auxiliary paying-out apparatus 12 is provided just before a looper thread tensioner 18 for multi-thread chain stitch of a multi-thread chain stitch looper system which feeds a looper thread 16 from a bobbin 14A of an interlock sewing machine 10 through said thread tensioner 18, a lower thread cam 20, a looper thread guide 22 and a looper 24 for multi-thread chain stitch into a sewing needle (not shown in the figure).

Figure 1:
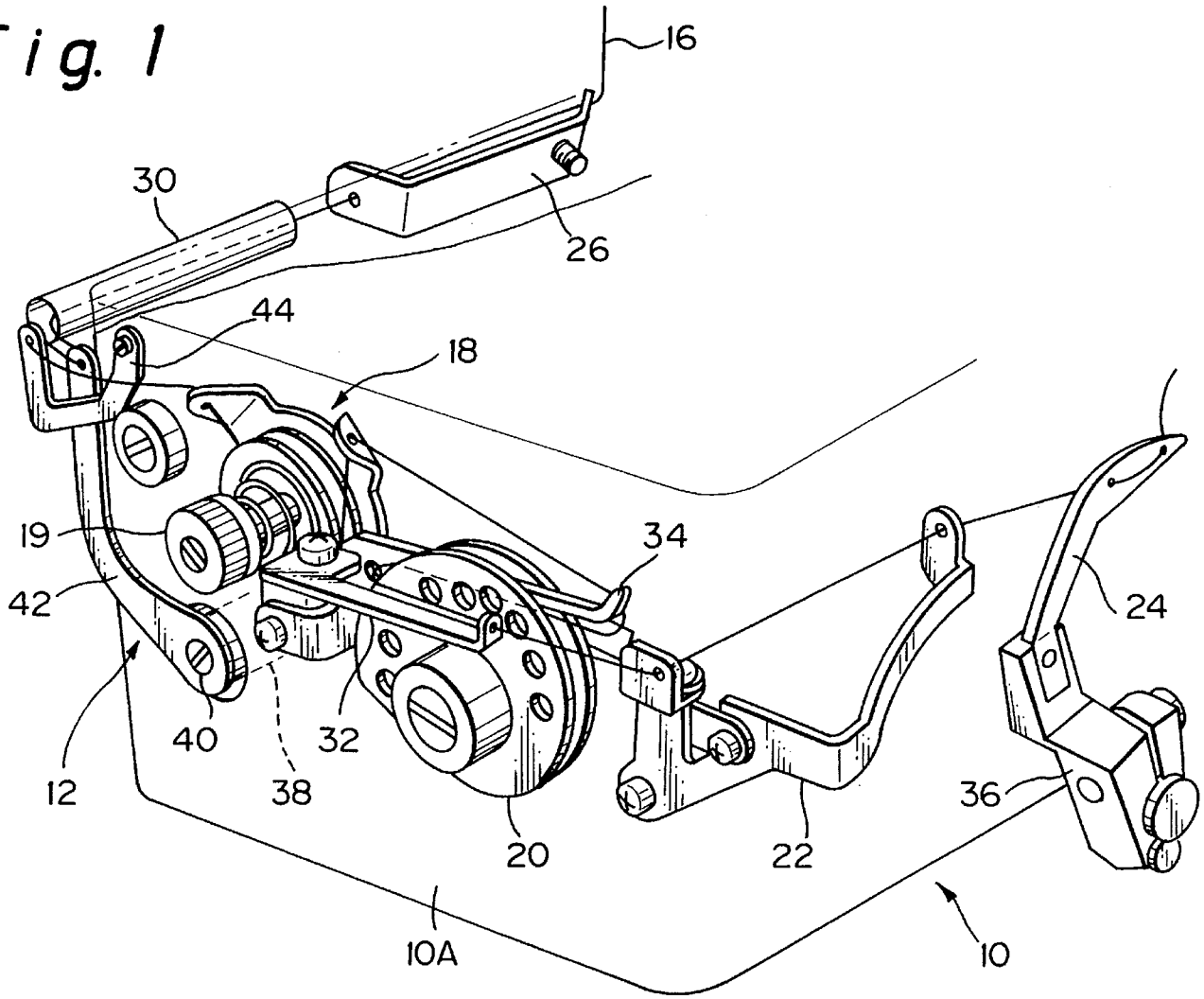
FIG. 1 is a perspective view showing an embodiment of a looper thread paying-out apparatus of sewing machine according to the present invention.

In FIG. 1, a looper thread guide for guiding a looper thread 16 fed from said bobbin 14A through a thread guide 28 (FIG. 2) is designated by 26 and a looper thread tension guide for multi-thread chain stitch arranged at the outlet side of the looper thread guide 26 is designated by 30. Furthermore, in FIG. 1, a lower thread cam guide is designated by 32, an intermediate guide by 34, a looper support arm for multi-thread chain stitch by 36 and a pulley interlocked with a main shaft of the sewing machine by 67 in FIG. 2, respectively.

Said auxiliary paying-out apparatus 12 consists of an auxiliary thread take-up 42 pivotably mounted at its base end by a screw 40 to the end of feed rock shaft 38 projecting from a frame 10A of the interlock sewing machine 10 near the underside of said thread tensioner 18 and a thread guide 44 fixed by a screw 43 to said frame 10A in a way of surrounding the free end (upper end) of said auxiliary thread take-up 42.

At the free end (upper end) of said thread take-up 42 is provided a thread hole 42A and also at the end of said thread guide 44 is provided a thread hole 44A, respectively.

Said auxiliary thread take-up 42 and said thread guide 44 make it possible cooperatively to feed the looper thread 16 into the thread tensioner 18 at a zero tension in such a way to pay out the looper thread 16 from the bobbin 16 when the auxiliary thread take-up 42 is oscillated clockwise in FIG. 1 and then to loosen the thread for said paid-out amount by approaching to the thread hole 44A of the thread guide 44 when oscillated counter-clockwise. A looper thread tension adjuster for multi-thread chain stitch is designated by 19 in FIG. 1.

Now, an oscillation mechanism of feed rock shaft 38 in the interlock sewing machine 10 will be described with reference to FIG. 4.

Figure 4:
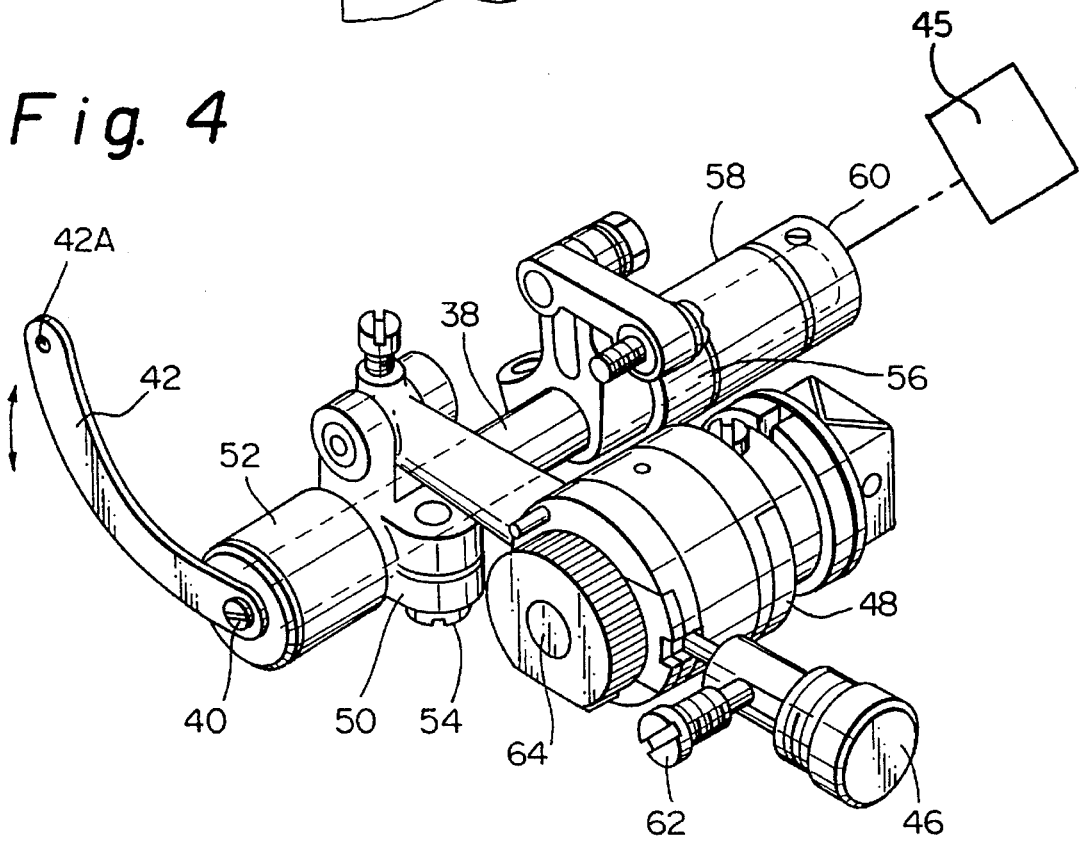
FIG. 4 is a perspective view showing the horizontal cloth feed adjusting mechanism of the same embodiment as shown in FIG. 1.

While a horizontal cloth feed at each stitch is carried out by a horizontal cloth feed mechanism indicted schematically by the designation 45 in FIG. 4. The horizontal cloth feed mechanism includes a feed rock rod and a feed dog (not shown in the figure) driven by a feed rock shaft 38, its feed pitch can be adjusted from a feed arm through said feed rock shaft 38 by changing an eccentricity of a feed cam (eccentric cam) which eccentricity can be adjusted by controlling a push-in stroke of a push button 46 in FIG. 4.

In FIG. 4, a feed shaft front metal is designated by 52, a set screw of the feed arm by 54, a thrust collar by 56, a feed shaft rear metal by 58, a thrust collar by 60, a set screw of said push button 46 by 62 and a main shaft of the interlock sewing machine 10 by 64, respectively.

An operation of the auxiliary paying-out apparatus 12 of the interlock sewing machine 10 according to above-mentioned embodiment will now be described.

During one complete rotation of the main shaft 67 as shown in FIG. 2 a sewing needle 68 executes one reciprocating motion as shown in FIGS. 5(B) through 5(G), thereby a multi-thread chain stitch seam 70 is produced.

Figure 5A:
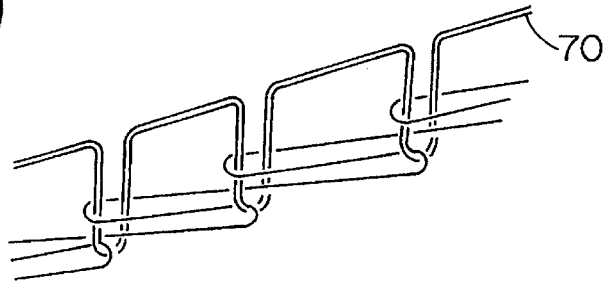
FIGS. 5(A) through 5(G) are perspective views showing a production process of multi-thread chain stitch seam by an interlock sewing machine.
Figure 5B:
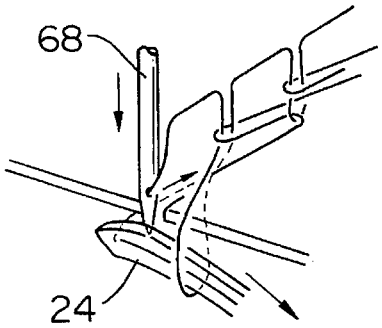
Figure 5C:
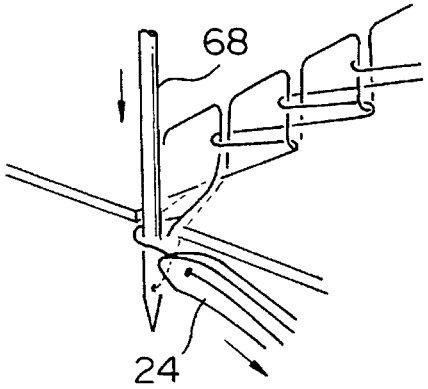
Figure 5D:
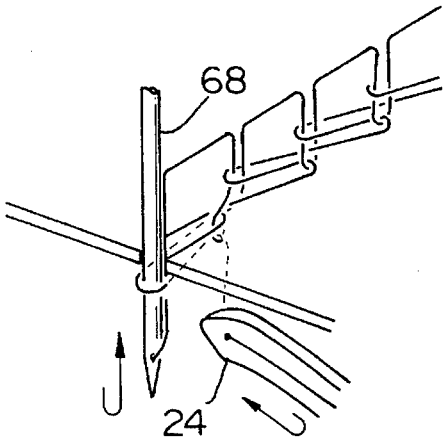
Figure 5E:
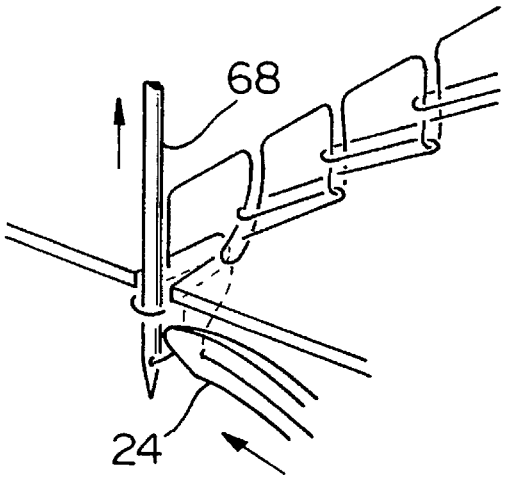
Figure 5F:
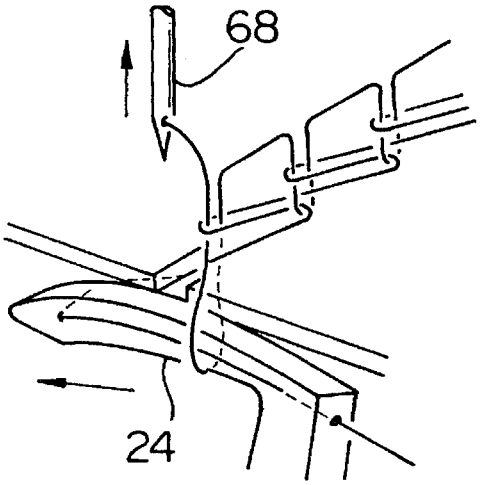

At the steps as shown in FIGS. 5(E) and 5(F), in the moment of oscillation of the looper 24 towards left side in the figures a looper thread 16 is drawn out through the looper thread tensioner 18.

As shown in FIG. 5(B), pick up of the thread at the back of the looper is effected. In FIG. 5(C), needle thread is removed out of the looper. In FIG. 5(D), the needle reaches to the downward dead point. In FIG. 5(E), the thread is picked up by the looper.

FIG. 5(F) shows a position in which the needle is approaching to the upward dead point.

Figure 5G:
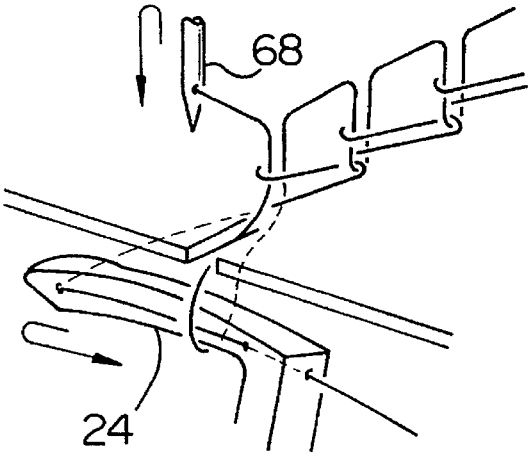

FIG. 5(G) shows a position in which the needle moves downwardly from the upward dead point.

During the downward movement of the sewing needle 68 as shown in FIGS. 5(B) through 5(D) said feed rock shaft 38 is oscillated clockwise in FIG. 1 synchronously to said downward movement.

Consequently, the thread take-up 42 mounted at its base end to the feed rock shaft 38 pays out the looper thread 16 from the bobbin 14A.

During the upward movement of the sewing needle 68 as shown in FIGS. 5(E) through 5(G) the feed rock shaft 38 is oscillated counter-clockwise in FIG. 1, thereby it can feed the looper thread 16 into the looper thread tensioner 18 at zero tension.

As the looper thread 16 can be fed into the looper thread tensioner 18 always at zero tension, even though a variation of paying-out tension of the thread from the bobbin 14A it does not give any influence to the side of the sewing needle 68 located at the downstream of the looper thread tensioner 18 so that a stable seam can be obtained.

While in the above embodiment the auxiliary thread take-up 42 of the auxiliary paying-out apparatus 12 is mounted to the feed rock shaft 38, the present invention is not limited to this embodiment but it is sufficient substantially if it can pay out the thread into the upstream side of the looper thread tensioner 18 corresponding to the amount of horizontal cloth feed and feed the looper thread towards the needle thread at zero tension.

Figure 6:
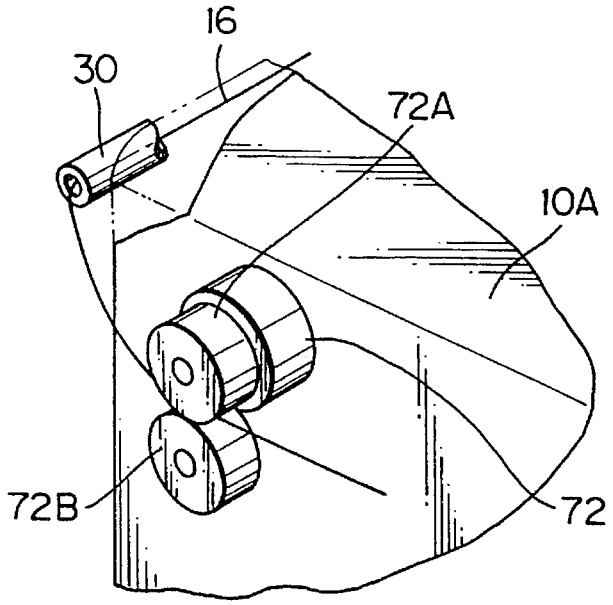
FIG. 6 is a perspective view showing a second embodiment of the present invention.
Figure 7A:
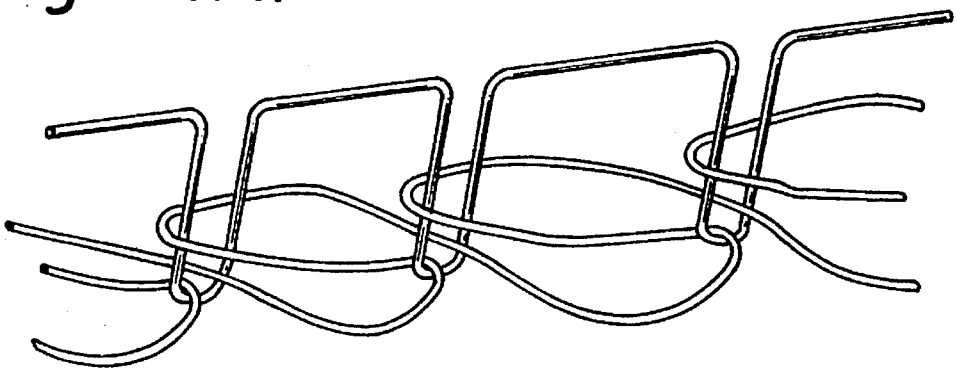
Fig. 7(A) PRIOR ART
FIGS. 7(A) and 7(B) are front views comparatively showing a multi-thread chain stitch seam produced by an interlock sewing machine at a lower thread paying-out tension FIG. 7(A) and at a higher thread paying-out tension FIG. 7(B), respectively.
Figure 7B:
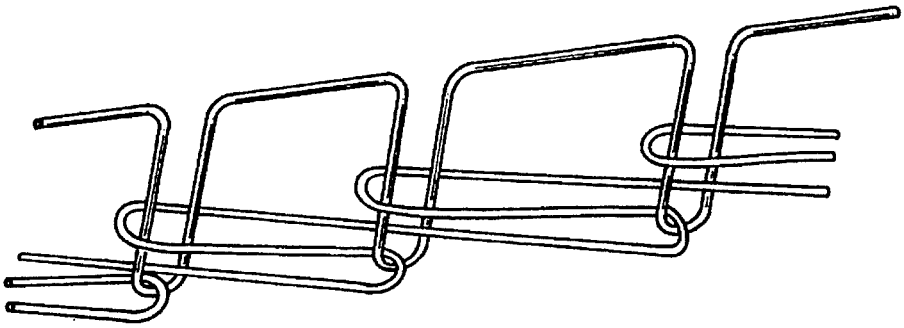
Fig. 7(B) PRIOR ART

Therefore, for example, it can be a pulse motor 72, such as an embodiment as shown in FIG. 6, which adjusts the feed amount of the looper thread 16 corresponding to the signal of the cloth feed amount. In FIG. 6, a roller driven by the pulse motor 72 is designated by 72A and a roller rotated in contact with said roller 72A is designated by 72B. The looper thread 16 is fed by these rollers 72A, 72B.

While the above-mentioned embodiment relates to a feeding system of the looper thread 16 of an interlock sewing machine 10, the present invention is not limited to this embodiment but it can be related to other sewing machine than the interlock sewing machine and other thread than the looper thread.

From the above description of the invention, those skilled in the art will perceive improvements, changes and modifications. Such improvements changes and modifications within the skill of the art are intended to be covered by the appended claims.

What is claimed is:

1. A looper thread paying-out apparatus of a sewing machine for feeding a thread from a bobbin through a thread tensioner and a thread take-up into a looper which is movable through a stitching stroke, said apparatus being characterized in that upstream of said thread tensioner an auxiliary paying-out apparatus is arranged for paying out a portion of thread for a length of one stitch just before each stitching stroke of the looper, said auxiliary paying-out apparatus includes an auxiliary thread take-up member pivotably mounted to a feed rock shaft for driving a horizontal cloth feed mechanism and a thread guide, said auxiliary thread take-up member and said thread guide cooperating to draw out and accumulate a portion of thread for a length of one stitch just before thread is drawn out through said thread tensioner into the looper.

2. A thread paying-out apparatus in a sewing machine for feeding a thread from a bobbin through a thread tensioner into a seam forming means, said apparatus comprising an auxiliary paying-out device arranged upstream of said thread tensioner for paying out a portion of thread for a length of one stitch corresponding to stitching movement of said seam forming means; said auxiliary paying-out device including an auxiliary thread take-up pivotably mounted on a feed rock shaft for driving a horizontal cloth feed mechanism and a thread guide for drawing out and accumulating said length of one stitch just before a thread is drawn out through said thread tensioner toward said seam forming means by cooperating with the free end of said auxiliary thread take-up wherein said auxiliary paying-out device is located near a free end of said auxiliary take-up.

3. A thread paying-out apparatus of a sewing machine as defined in claim 2 wherein said auxiliary paying-out device further comprises a pulse motor for paying out a thread by being rotated corresponding to an amount of cloth feed at said horizontal cloth mechanism.

4. A sewing machine comprising a source of thread which is moved along a thread feed path during operation of said sewing machine, a looper which engages the thread and is movable through stitching strokes during operation of the sewing machine, said looper being operable to pull thread along at least a portion of the thread feed path during each of the stitching strokes of said looper, a thread tensioner disposed in engagement with the thread at a location along the thread feed path between said looper and said source of thread, and a thread paying-out apparatus disposed in engagement with the thread at a location along the thread feed path between said source of thread and said thread tensioner, said thread paying-out apparatus being operable to pull thread from the source of thread between each stitching stroke of said looper to minimize tension in the thread disposed along the thread feed path between said thread paying-out apparatus and said thread tensioner during movement of said looper through a stitching stroke.

5. A sewing machine as set forth in claim 4 wherein said thread paying-out apparatus includes an auxiliary thread take-up member which engages the thread at a location along the thread feed path between said source of thread and said thread tensioner, said sewing machine further including a feed rock shaft connected with said auxiliary thread take-up member, said feed rock shaft being oscillatable to oscillate said auxiliary thread take-up member during operation of said sewing machine.

6. A sewing machine as set forth in claim 4 wherein said thread paying-out apparatus includes a pulse motor and a member which is connected with said pulse motor and engages the thread, said member being rotatable by said pulse motor to move thread engaged by said member along the thread feed path toward said thread tensioner.

* * * * *